United States Patent [19]

Vecellio

[11] Patent Number: 4,556,756

[45] Date of Patent: Dec. 3, 1985

[54] ELECTRIC POWER CABLE IMPREGNATED WITH INSULATING FLUID

[75] Inventor: Bernardino Vecellio, Milan, Italy

[73] Assignee: Societa' Cavi Pirelli S.p.A., Milan, Italy

[21] Appl. No.: 549,004

[22] Filed: Nov. 3, 1983

Related U.S. Application Data

[63] Continuation-in-part of Ser. No. 339,162, Jan. 13, 1982, abandoned.

[30] Foreign Application Priority Data

Jan. 16, 1981 [IT] Italy ..... 19164 A/81

[51] Int. Cl.[4] ..... H01B 9/06; H01B 7/14; H01B 3/20

[52] U.S. Cl. ..... 174/25 R; 174/25 C; 252/570

[58] Field of Search ..... 252/570; 174/25 R, 25 C; 361/327; 336/94

[56] References Cited

U.S. PATENT DOCUMENTS

| | | | |
|---|---|---|---|
| 3,294,123 | 12/1966 | Foster et al. | 174/25 R |
| 3,598,691 | 8/1971 | Pasini | 174/25 R |
| 3,930,112 | 12/1975 | Pasini | 174/25 C |
| 4,119,555 | 10/1978 | Jay | 252/581 |

FOREIGN PATENT DOCUMENTS

| | | | |
|---|---|---|---|
| EP-1494 | 4/1979 | European Pat. Off. | 252/570 |
| 50-86700 | 7/1975 | Japan | 252/570 |

*Primary Examiner*—Paul Lieberman
*Assistant Examiner*—Robert A. Wax
*Attorney, Agent, or Firm*—Brooks Haidt Haffner & Delahunty

[57] ABSTRACT

An electric power cable insulating fluid which is a substance corresponding to the following formula where R is chosen between the following two radicals:

and an electric power cable with its insulation impregnated with such fluid.

3 Claims, 1 Drawing Figure

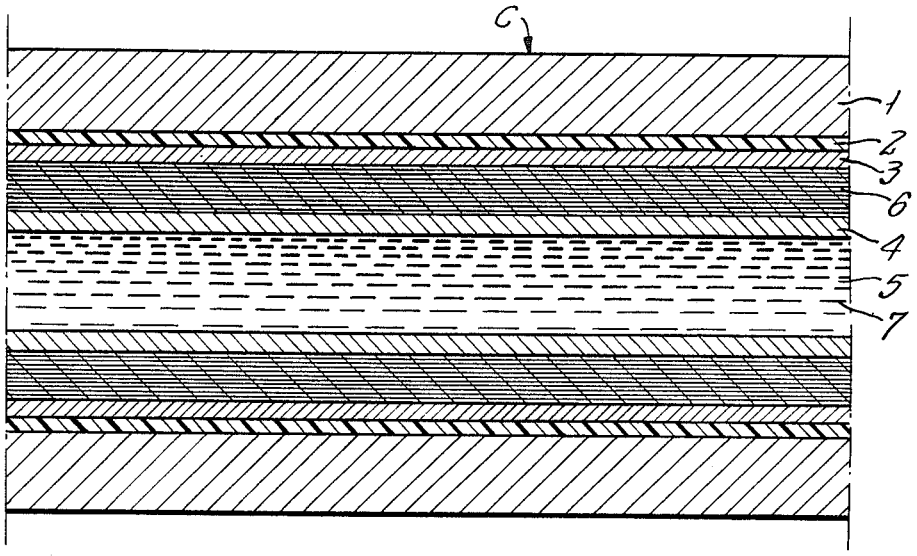
C
1
2
3
6
4
5
7

ELECTRIC POWER CABLE IMPREGNATED WITH INSULATING FLUID

This application is a continuation-in-part of application Ser. No. 339,162 filed Jan. 13, 1982, now abandoned.

The present invention relates to an electric cable impregnated with an insulating fluid and more specifically, to an electric submarine cable impregnated with an insulating fluid, and in particular, to an electric submarine cable impregnated with an insulating fluid that is particularly adapted to being laid at great depths.

Moreover, the present invention also relates to an insulating fluid for electric cables and in particular, for electric submarine cables especially suited to be laid at great depths.

With an underwater power cable which is oil filled, care must be taken to minimize stresses on the cable sheath, and hence, the armoring, when the cable is lowered into the water and when the cable transmits electric power. This means that the density of the insulating oil should be substantially equal to the density of the water, and the insulation should be permeable to the oil so that the oil can move radially of the insulation. Thus, during the transmission of electric power, there are thermal changes, or transients, within the cable, and to prevent stresses on the sheath, the oil, which has a greater thermal coefficient of expansion than the thermal coefficient of expansion of the other cable components, must be able to move radially of the insulation. For example, if the cable temperature increases, the volume of the oil increases more than the volume of the other cable components and if the insulation is oil permeable, the oil moves radially of the insulation toward the cable conduit and longitudinally of the conduit which leads exteriorly of the cable. In this way, overpressure in the cable with thermal changes is avoided. With such avoidance of overpressure, a reduction in the cable armoring is possible.

An insulating fluid for electric cables, and more particularly, for electric submarine cables laid in the sea must, in fact, possess at least the following properties:

(a) its density has to be substantially equal to that of the sea water, so as to prevent any differences arising in the hydrostatic pressure between the inside and the outside of the cable which, if existing, could cause stresses in the armoring and in the covering sheath of the cable itself. This problem increases when the depth at which the cable is laid increases;

(b) the viscosity of the insulating fluid, at whatever temperature to which the cable may be subjected and in any position of the cable, must be such as to allow the movement of said insulating fluid along the cable;

(c) the factor of dielectric dispersion or tan $\delta$ of the insulating fluid, must be small and stable with the passing of time, so as to allow a good efficiency of the power transmission; and (d) the gas adsorption capacity on the part of the insulating fluid, known in the electrical-cable field art as "gassing", has to be good, so as to prevent the risks of perforations.

It is very difficult to find all these properties, together, in a single insulating fluid. For this reason, in the present state of the art, there exist very few known and used insulating fluids for electrical cables and only a few of these are useful for the insulating fluid for electrical submarine cables, especially, for submarine electric cables laid at great depths. In the latter, the density of the insulating fluid plays a fundamental role, said density having to be as near as possible to that of the sea water to provide the greatest reduction as possible in the mechanical stresses in the cable. Also, the factor of dielectric dispersion must have a value such as to allow the manufacture of cable tracts having long lengths.

The known types of insulating fluids for electrical cables and, in particular, for electric submarine cables impregnated with insulating fluids, are reduced to mineral oils and to alkylbenzenes having aliphatic chains from 9 to 12 carbon atoms such as, for example, decylbenzene. The known insulating fluids have been adopted in practice since they are those which have the closest to the ideal characteristics that an insulating fluid for cables must possess, particularly for submarine electric cables, but the known insulating fluids do not have the required characteristics of a satisfactory value.

One object of the present invention is an electric cable impregnated with an insulating fluid, and in particular, an electric submarine cable impregnated with an insulating fluid that is better than the prior art insulating fluids.

Another object of the present invention is an insulating fluid for electric cables and, in particular, for electric submarine cables, which possess the necessary characteristics for rendering it suitable for being used in cables and, in particular, for submarine cables to be laid at great depths and which has properties closest to those which are optimum.

The electric cable impregnated with insulating fluid of the invention comprises a conductor encircled by a solid, stratified insulation, and is provided with at least one longitudinal conduit capable of allowing the circulation of an insulating fluid, said solid, stratified insulation being impregnated by said insulating fluid. Said insulating fluid comprises a substance having the formula:

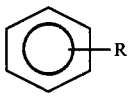

where R is a radical selected from the following two:

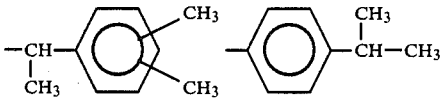

The insulating fluid should also have a density at 20° C. in the range from about 0.97 gr/cm$^3$ to about 1 gr/cm$^3$ and a viscosity at 20° C. in the range from about 8 to about 12 centipoises, the latter viscosity being from 40% to 60% greater than a conventional insulating fluid, such as decylbenzene. Any increase in internal cable pressure when the cable has a long length and when such a higher viscosity insulating fluid is used can be compensated for by increasing the armoring around the cable sheath.

The present invention will be better understood from the following detailed description, given solely by way of example, with reference to the single FIGURE of the accompanying drawings which is a longitudinal crosssection of a length of electric cable that is particularly suitable for use as a submarine cable.

The electric cable, of the type impregnated with an insulating fluid which is particularly suitable for use as a submarine cable and which is shown in the drawing, has a structure which is known in the art.

With reference to the drawing and proceeding from outside toward inside, the cable C has an armoring 1, superimposed on a sheath 2 of an elastomeric material. Beneath the sheath 2, there is present a tubular metallic sheath 3 that, in the case of submarine cables, is a lead sheath. Co-axial of the metallic sheath 3 and enclosed within it, is a copper electric conductor 4 that has, on its inside, a conduit 5 completely filled with an insulating fluid and, more specifically, by an insulating liquid 7.

Between the conductor 4 and the sheath 3, there is interposed a layer of solid, stratified insulation 6 constituted by a plurality of tapes of insulating material which are at least radially permeable from the outside of insulation 6 to the inside thereof, and viceversa to the insulating fluid, or liquid, 7, such as, for example, insulating paper impregnated with the same insulating fluid 7 with which the conduit 5 is filled.

The air resistance of the tapes should not exceed $15\times10^6$ cm$^{-2}$ Emanueli units and preferably, is in the range from about $4\times10^6$ cm$^{-2}$ to about $8\times10^6$ cm$^{-2}$ Emanueli units so that the insulation 6 will have the required permeability to the insulating fluid 7.

The insulating liquid 7 is an organic substance having a density at 20° C. from about 0.97 gr/cm$^3$ to about 1 gr/cm$^3$ and a viscosity at 20° C. from about 8 to about 12 centipoises and corresponding to the following chemical formula:

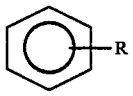

where R is chosen between the following two radicals:

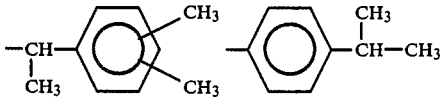

Thus, the insulating liquid 7 can be constituted by a substance corresponding to the chemical formula:

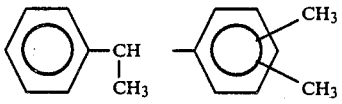

called phenylxylylethane or by the substance corresponding to the chemical formula:

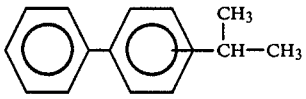

called isopropyldiphenyl, or else by mixtures of these two substances.

In particular, the isopropyldiphenyl consists of para-isopropyldiphenyl, or of meta-isopropyldiphenyl, or of mixtures of these two isomers.

Of the two substances described above (for which we shall give the chemical-physical characteristics further on) of particular interest is the m-isopropyldiphenyl, which possesses a very high resistance to aging, in the presence of metals such as copper or lead.

The following TABLE I sets forth the chemical-physical characteristics of the two substances of the present invention and sets forth the chemical-physical characteristics of one of the known insulating fluids more commonly used for cables and, in particular, for submarine electric cables.

TABLE I

| CHEMICAL-PHYSICAL CHARACTERISTICS | Phenylxylylethane | Isopropyldiphenyl | Prior Art DECYLBENZENE |
|---|---|---|---|
| Density at 20° C. in gr/cm$^2$ | 0.9874 | 0.9841 | 0.8613 |
| Inflammability in open cup in °C. | 153 | 151 | 124 |
| Viscosity at 20° C. in centipoises | 8.3 | 9.5 | 5 |
| Dielectric Loss Factor at 100° C. tan | 0.0003 | 0.0003 | 0.0001 |

When comparing the chemical-physical characteristics of the insulating fluids of the present invention, with the chemical-physical characteristics of the prior art insulating fluid that is most used for cables, it can be seen, first and foremost, that the density of the fluids of the invention are closer to that of sea water. This signifies that an electric submarine cable according to the present invention, which utilizes an insulating fluid of the present invention, has only small mechanical stresses since the difference between the external and the internal pressures, owing to the sinking of the cable, is less than that occurring in the known cables. Moreover, this advantage becomes even more important when the depth of cable laying is increased. This fact also makes it possible to reduce the armoring of a cable according to the invention with the same safety factor as cables of the known type which utilize the insulating fluids of the prior art.

By comparing the chemical-physical characteristics of the insulating fluids of the present invention, with the characteristics of the prior art insulating fluid which is most used, it will be observed that the values of the dielectric loss factor are good and are practically equivalent to the dielectric loss factor of the prior art fluid. A low dielectric loss factor is, of course, a necessary characteristic in an electric cable.

One advantage offered by a cable according to the present invention, which results from using insulating fluids of the invention, is the high absorption capacity for gas, which brings about a greater guarantee of safety with respect to electrical perforation risks.

What is more, it is to be noted that the anti-flame characteristics for an insulating fluid of the invention, are better than the anti-flame characteristics of the prior art insulating fluids for cables. This fact makes it possible to simplify the manufacturing process for electrical cables in general, and for submarine cables, in particular, by giving a greater guarantee against fires at least during the manufacture of the cables themselves.

Of course, the insulating fluid of the invention may include other materials which are conventionally used in the insulating fluids for electric cables and which do not adversely affect the desired characteristics.

Although preferred embodiments of the present invention have been described and illustrated, it will be apparent to those skilled in the art that various modifications may be made without departing from the principles of the invention.

The embodiments of the invention in which an exclusive property or privilege is claimed are defined as follows:

1. An electric underwater cable impregnated with an insulating fluid, said cable comprising an inner conductor having at least one longitudinal conduit therewithin for the circulation of said insulating fluid, a sheath around said conductor with the interior thereof spaced from said conductor, and stratified, solid insulation intermediate said conductor and said sheath and consisting essentially of a plurality of layers of wound paper tape around said inner conductor, said layers of paper tape being impregnated with said fluid and providing insulation which will withstand the voltage between said conductor and said sheath and said tape having an air resistance, expressed in Emanueli units, not exceeding $15\times10^6$ $cm^{-2}$, said solid insulation being free of tape which would prevent flow of said fluid through said wound tape to and from said conduit and said insulating fluid comprising a substance having the formula:

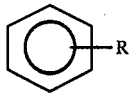

where R is a radical selected from the group consisting of:

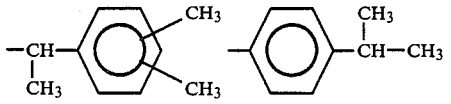

and mixtures thereof, said fluid having a density and a viscosity at 20° C., respectively, from about 0.97 $gr/cm^3$ to about 1 $gr/cm^3$ and from about 8 centipoises to about 12 centipoises.

2. An electric cable as set forth in claim 1, wherein said substance is phenylxylylethane.

3. An electric cable as set forth in claim 1 wherein said substance is selected from the group consisting of paraisopropyldiphenyl and metaisopropyldiphenyl.

* * * * *